United States Patent [19]

Skiera

[11] 4,198,908

[45] Apr. 22, 1980

[54] DRIVE FOR AN INK SUPPLYING DEVICE OF A ROTARY PRINTING PRESS

[75] Inventor: Heinz Skiera, Leipzig, German Democratic Rep.

[73] Assignee: VEB Polygraph Druckmaschinenwerke Leipzig, Leipzig, German Democratic Rep.

[21] Appl. No.: 894,847

[22] Filed: Apr. 10, 1978

Related U.S. Application Data

[63] Continuation-in-part of Ser. No. 885,814, Mar. 13, 1978, abandoned.

[30] Foreign Application Priority Data

Mar. 11, 1977 [DD] German Democratic Rep. ... 197794

[51] Int. Cl.[2] ..... B41F 13/00; B41F 13/10; B41F 13/14

[52] U.S. Cl. ..... 101/217; 101/220; 101/350; 101/DIG. 6

[58] Field of Search ..... 101/349, 350, 351, 352, 101/363, DIG. 6, 216, 219, 217, 218, 177, 220, 221, 206, 207, 205, 348

[56] References Cited

U.S. PATENT DOCUMENTS

| | | | |
|---|---|---|---|
| 2,297,005 | 9/1942 | Livingston | 101/350 X |
| 2,425,529 | 8/1947 | Harless | 101/351 |
| 2,447,872 | 8/1948 | Riggs et al. | 101/349 X |
| 2,891,473 | 6/1959 | Faeber | 101/350 |
| 3,141,408 | 7/1964 | Bernardi et al. | 101/350 X |
| 3,688,696 | 9/1972 | Treff | 101/350 |
| 3,698,313 | 10/1972 | Tafel | 101/350 |
| 3,908,545 | 9/1975 | Simeth | 101/350 |

FOREIGN PATENT DOCUMENTS

| | | | |
|---|---|---|---|
| 2031504 | 3/1971 | Fed. Rep. of Germany | 101/349 |

*Primary Examiner*—J. Reed Fisher
*Attorney, Agent, or Firm*—Michael J. Striker

[57] ABSTRACT

An ink supplying device which supplies ink to a plate cylinder and thus to a blanket cylinder of a rotary printing press includes a plurality of rollers which are in contact with one another and with the plate cylinder, respectively. The device further includes an ink supply fountain, an ink supply roll and a ductor roll which is displaceable between two positions in one of which it contacts the ink supply roll and is replenished with ink and in the other of which it contacts one of the rollers and delivers the ink thereto. A drive for the ink supply device includes a main drive shaft and a transmission which directly drives the above-mentioned one roller while circumventing the other rollers so that a jolt which occurs upon the contact of the ductor roll with the one roller is not transmitted to the other rollers. This transmission may also drive the ink supply roll, as well as the arrangement for displacing the ductor roll, while another transmission is interposed between the main drive shaft and the remaining rollers which may also drive the above-mentioned cylinders. Another of the rollers is interposed between the one roller and a still further roller and is driven in rotation solely by friction between itself and the one or further roller.

9 Claims, 3 Drawing Figures

1
9
10
9'
11
12
12'
13
14
14'
17
15
5'
5
3'
3
4'
4
16
6'
17

DRIVE FOR AN INK SUPPLYING DEVICE OF A ROTARY PRINTING PRESS

CROSS-REFERENCE TO RELATED APPLICATION

This application is a continuation-in-part of application Ser. No. 885,814, filed Mar. 13, 1978, entitled "Drive for an Ink Supplying Device of a Rotary Printing Press" now abandoned.

BACKGROUND OF THE INVENTION

The present invention relates to a rotary printing press in general, and more particularly to a drive for an ink supplying device of such a press.

Rotary printing presses are well known and in widespread use, particularly in the printing industry so that it is not necessary to dwell on the details of such presses. Suffice it to say that such machines include plate cylinders which carry the plates on which the images that are to be printed on an advancing web are formed, a blanket cylinder being interposed between the respective plate cylinder and the advancing web and serving to transfer the ink replica of the image from the plate cylinder to the advancing web. The printing ink for the replica is supplied to and appropriately distributed over the plate cylinder by an ink supply device which is constituted by a plurality of distributing, transfer and application rollers that are in respective contact with one another and with the plate cylinder. The printing image is often delivered to one of the distributing rollers from an ink supply roll of an ink supply fountain by a ductor roll, which is a roll mounted not only for rotation but also for displacement between two positions in one of which it contacts the ink supply roll to be replenished with the printing ink thereby, and in the other of which it contacts the one distributing roller to deliver the printing ink thereto. Then, a drive is provided for driving the distributing rollers, the plate and blanket cylinders, the displacing arrangement for the ductor roll, and the ink supply roll, or several individual drives may be provided for separately driving selected ones of the above-mentioned components. The drives are of different constructions, some of which will be presently discussed in connection with a rotary printing press of the above-discussed type. However, it will be appreciated that the drive of the present invention and the associated ink supplying device may also be used in other types of rotary printing machines.

It is also well known that, in the above-discussed ink supplying device, the ink supply roll rotates relatively slowly while the distributing roller with which the ductor roll comes into contact when delivering the ink thereto in the other of the above-discussed positions rotates at a relatively high peripheral speed which actually corresponds to the speed of advancement of the advancing web. The ductor roll itself is not being driven in rotation but rather is entrained by the ink supply roll during the short-lived rolling contact therewith while the ductor roll is in its replenishing position. While in such a rolling contact, the ink supply roll delivers a narrower or a wider strip of the printing ink to the ductor roll. On the other hand, when the ductor roll reaches the delivering position thereof, for a short period of time, it will be entrained for a rolling contact with the above-mentioned distribution roller for rotating at a peripheral speed which considerably exceeds the peripheral speed which the ductor roll has acquired during its contact with the ink supply roll. While in contact with the distributing roller, the ductor roll will deliver the printing ink to the distributing roller from where the printing ink will be transmitted to the remaining transfer, distributing and application rollers until it reaches, in the desired distribution and other conditions, the plate roller.

It will be appreciated that when the ductor roll rotating at a relatively low peripheral speed is entrained by the distributing roller with which it comes into contact in the delivering position thereof for rotation at a much higher peripheral speed, there will come into existence a jolt resulting from the sudden energy demand needed for the rapid acceleration of the ductor roll, which leads to a multitude of unpleasant phenomena well known to those familiar with the printing industry, most, if not all, of which adversely affect the printing quality.

This problem has already been recognized before, and some solutions either partially or fully avoiding this problem have already been proposed. So, for instance, in the U.S. Pat. No. 3,002,451, the driving connection between the printing cylinders and the rollers of the ink supplying device is made relatively elastic by using roller-equipped chains or the like. However, this solution is only partial inasmuch as it only brings about a certain damping of the above-mentioned driving jolt.

To reduce the adverse affects of the above-mentioned jolt to the greatest feasible extent, it has been already proposed in the German published patent application DT-OS No. 20 31 504 to so construct an ink supplying device of a rotary printing press as to include a motor for accelerating the ductor roll. Thus, the ductor roll is accelerated during its displacement from the replenishing into the delivering position by a separate driving roll which is in a frictional contact with the ductor roll in such a manner that the jolt to which the ink supplying device is subjected at the moment of contact of the ductor roll with the associated distributing roller is reduced to a minimum.

However, this construction suffers of several drawbacks. One of the problems encountered in this arrangement is the relatively high manufacturing and even operating cost of this arrangement. On the other hand, it is a disadvantage of this arrangement that the driving roll which is associated with the ductor roll is located outside of the path of flow of the printing ink and thus acts as an undesired ink storage. Thus, as a result of the provision of this separate and additional driving roll, the ink supplying device becomes undesirably sluggish as to the possibility of desired or necessary changes in the amounts and exact color of the printing ink. In other words, any adjustments and changes attended to at the ink measuring or metering arrangement will reflect in the quality of the printed matter only after a considerable period of time.

In order to avoid this disadvantage, the U.S. Pat. No. 3,688,696 proposed to so construct the accelerating drive that the motor which drives the ductor roll by means of two V-belts, is put into action only when the ductor roll dissociates itself from the ink supply roll. This patent reveals that the speed of the motor is to be so controlled during the displacement of the ductor roll that the latter achieves a relatively high peripheral speed before it reaches and contacts the respective distributing roller. A speedometer is connected to the motor and is operative for discontinuing the operation of the motor when the latter has achieved a certain number of revolutions per minute.

However, even this arrangement is disadvantageous in several respects. First of all, even this arrangement is rather expensive both in terms of material and labor expense. Furthermore, when the rotary printing press is operated at the speeds which are usual nowadays, the full cycle of displacement of the ductor roll takes only about 0.5 seconds. Thus, the acceleration phase, which coincides at least with a greater part of the displacement of the ductor roll between the ink supply roll and the respective distributing roller, lies in the range of one-tenth of a second. Thus, it will become evident that there will be a high loading, especially of the motor and, based thereon, a high probability of even frequent malfunctions cannot be avoided.

SUMMARY OF THE INVENTION

Accordingly, it is a general object of the present invention to avoid the disadvantages of the prior art.

More particularly, it is an object of the present invention to so construct a drive for an ink-supplying device of a rotary printing press as not to be possessed of the disadvantages of a conventional drive of the same type. A further object of the present invention is to design a drive of the above-mentioned type which avoids the detrimental influence of the above-discussed jolt on the operation of the printing cylinders.

A concomitant object of the present invention is to develop a drive for use in rotary printing presses for driving the ink supplying devices thereof which is simple in construction, inexpensive to manufacture and maintain, and reliable nevertheless.

In pursuance of these objects and others which will become apparent hereafter, one feature of the present invention resides, in a rotary printing press, briefly stated, in a combination comprising a support; means for printing images on an advancing web, including at least one plate cylinder mounted on the support for rotation and at least one blanket cylinder rotatably mounted on the support intermediate and in contact with the plate cylinder and with the advancing web; means for supplying printing ink to the tape cylinder, including an ink supply fountain, an ink supply roll thereat, a plurality of rollers mounted on the support for rotation in contact with one another and with the plate cylinder, respectively, and means for periodically delivering the ink from the ink supply roll to one of the rollers, the periodically delivering means including a ductor roll mounted on the support for rotation and for displacement between a replenishing and a delivering position in contact with the ink supply roll and with the one roller, respectively. In this context, the present invention is especially concerned with means for driving the printing and supplying means, wherein the driving means includes a main driving shaft and a gear transmission that drives the one roller directly from the main driving shaft and circumvents the remaining rollers so that the latter are unaffected when the one roller is subjected to a jolt upon contact with the ductor roll in the above-mentioned delivering position as a result of a difference between peripheral speeds of rotation of the ductor roll, on the one hand, and of the one roller, on the other hand. This arrangement is particularly advantageous in that it is not necessary to provide a separate drive for the ductor roll; rather, the ductor roll is driven in rotation by its frictional engagement and rolling contact with the ink supply roll, on the one hand and the one roller, on the other hand. While the drive of the present invention does not avoid the jolt, it is so constructed that this jolt is not transmitted into the remainder of the ink-supply device or to their gear transmission and thus to the driving gears which drive the printing cylinders.

Advantageously, the above-mentioned rollers include distributing rollers, transfer rollers interposed between the distributing rollers and application rollers which are interposed between the distributing rollers and the plate cylinder. Then, it is particularly advantageous when the above-mentioned one roller is one of the distributing rollers, when the transfer rollers include on transfer roller which is interposed between the above-mentioned one distributing roller and another of the distributing rollers, the one transfer roller being driven in rotation solely as a result of friction between the same and the above-mentioned one and other of the distributing rollers.

As already indicated above, the driving means of the present invention further includes another transmission which drives at least the other distributing roller from the main shaft. However, the other transmission may also drive the remaining distributing rollers and the plate and blanket cylinders. As a result of this arrangement, there are provided, so to speak, two separate transmission branches which do not influence one another.

A particularly advantageous ink-supplying device is obtained when the transfer rollers or the application rollers, but preferably both, have at least a layer of rubber at their respective peripheries.

To advantage, the above-mentioned supplying means further includes means for mounting the ductor roll on the support for displacement between the replenishing and delivering positions, and means for displacing the ductor roll between the positions thereof, the first-mentioned transmission also driving the displacing means. In this context, it is particularly advantageous when the displacing means includes a cam mounted on the support for rotation, and a cam follower connected to the ductor roll for joint displacement therewith. According to a further facet of the present invention, it is advantageous when the first-mentioned transmission also drives the ink supply roll. Then, it is also advantageous for the first-mentioned transmission to drive the ink supply roll, on the one hand, and the one roller, on the other hand, at different peripheral speeds.

In addition to the advantages which have already been mentioned above, the solution presented by the present invention has some additional advantages. First of all, it is to be mentioned that the high expenditure which is needed when it is desired to achieve the extremely rapid and high acceleration of the ductor roll during the displacement of the latter, is avoided. On the other hand, it is advantageous that the torque increase which comes into existence on the main driving shaft as a result of the forces which act on the first-mentioned transmission during the above-mentioned jolt, cannot result in any disturbances which would adversely affect the quality of the printing operation, particularly in view of the fact that the magnitude of such torque increase is negligible when compared to the resistance of the main driving shaft to torsional forces. A further advantage is that the torsional jolt is so strongly reduced by the slippage which occurs at and by the elasticity of the above-mentioned one transfer roller including the layer of rubber that any possibility of oscillatory excitement of the remainder of the ink-supplying device and thus also at the printing cylinders is altogether eliminated.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
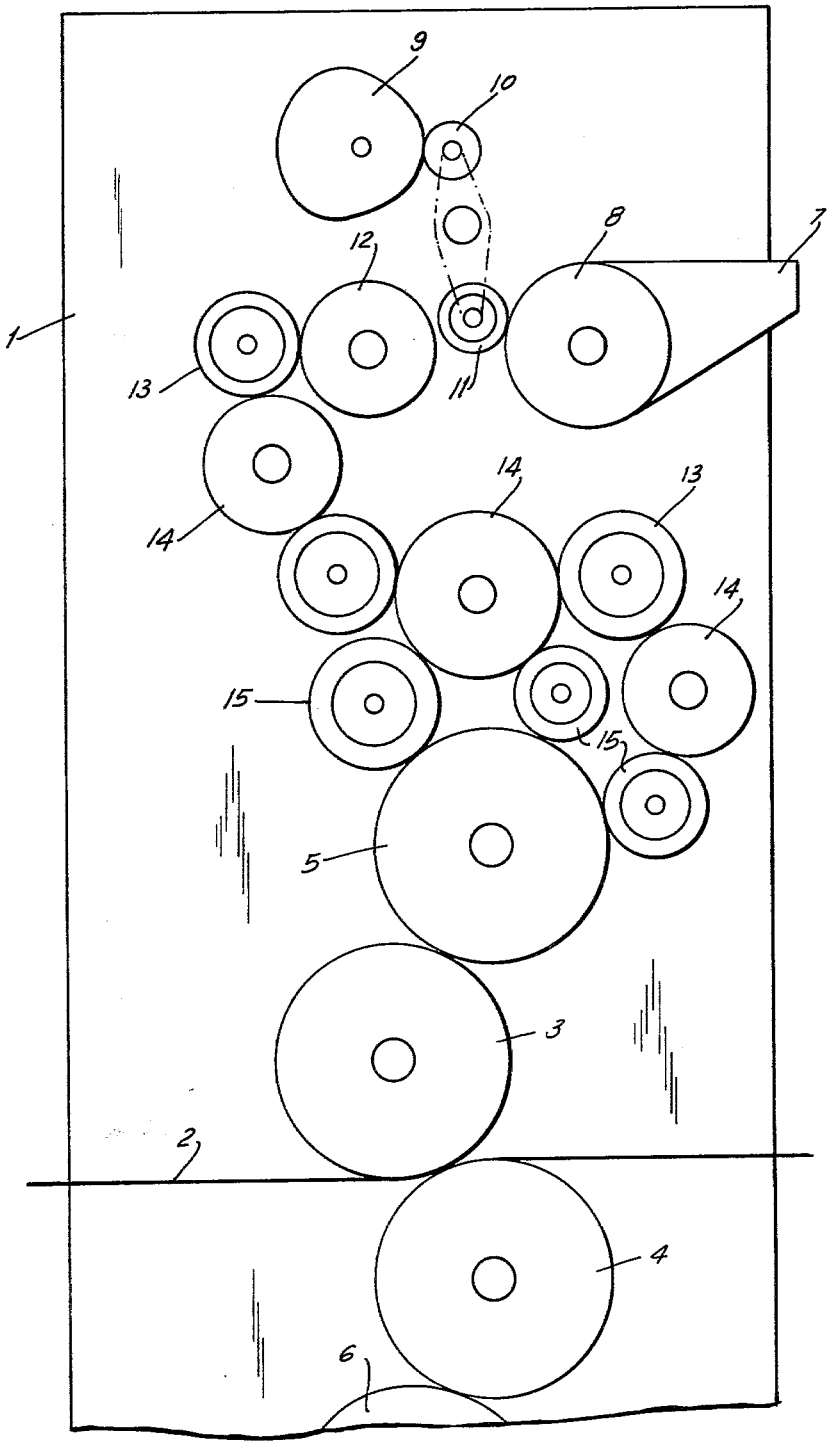
FIG. 1 is a diagrammatic illustration of a fragment of a rotary printing press illustrating especially the ink-supplying device and the printing cylinders of an obverse and reverse printing station of a rotary offset printing press.

Referring now to the drawings in detail, and first to FIG. 1 thereof, it may be seen that the reference numeral 1 indicates a support or a frame of the printing machine. Two blanket cylinders 3 and 4 are arranged and supported on the walls of the frame 1 above and below a web 2 both major surfaces of which are to be provided with printed matter. Furthermore, plate cylinders 5 and 6 respectively associated with the rubber-blanket cylinders 3 and 4, respectively, are also supported on the frame 1. An ink-supply device is associated with each of the plate cylinders 5 and 6. However, in order not to unduly encumber the drawing, only that ink-supplying device and its associated drive which supplies ink to the plate cylinder 5 has been illustrated.

The ink-supplying device includes an ink supply fountain 7 which accommodates a supply of the ink. An ink supply roll 8 is arranged at the ink supply fountain 7 and picks up ink from the latter while rotating. A strip of the printing ink is supplied to a ductor roll 11 each time the ductor roll 11, the displacement of which is controlled by a cam 9 and a cam follower 10, contacts the ink supply roll 8 in a replenishing position of the ductor roll 11. On the other hand, when the ductor roll reaches its other extreme position, or delivering position, in which the ductor roll contacts a first distributing roller 12, the ink is delivered and transferred from the ductor roll 11 to the first distributing roller 12. From there, the ink proceeds, while being distributed and spread thin, over a plurality of transfer rollers 13 which are provided at least with a layer of rubber at their respective peripheries, to further distributing rollers 14 and further transfer rollers 13, to application rollers 15 and from there to the printing plates of the plate cylinder 5. As particularly clearly seen in FIG. 3, the respective rollers 12 and 14, cylinders 3, 5, and the roll 8, as well as the cam 9, are mounted on common shafts with various gears of the drive of the present invention, which gears, for the sake of simplicity, have been identified with the same reference numerals as the above-mentioned components which are mounted on the shared shafts therewith for joint rotation, except that these reference numerals of the gears have been supplemented with primes.

Figure 2:
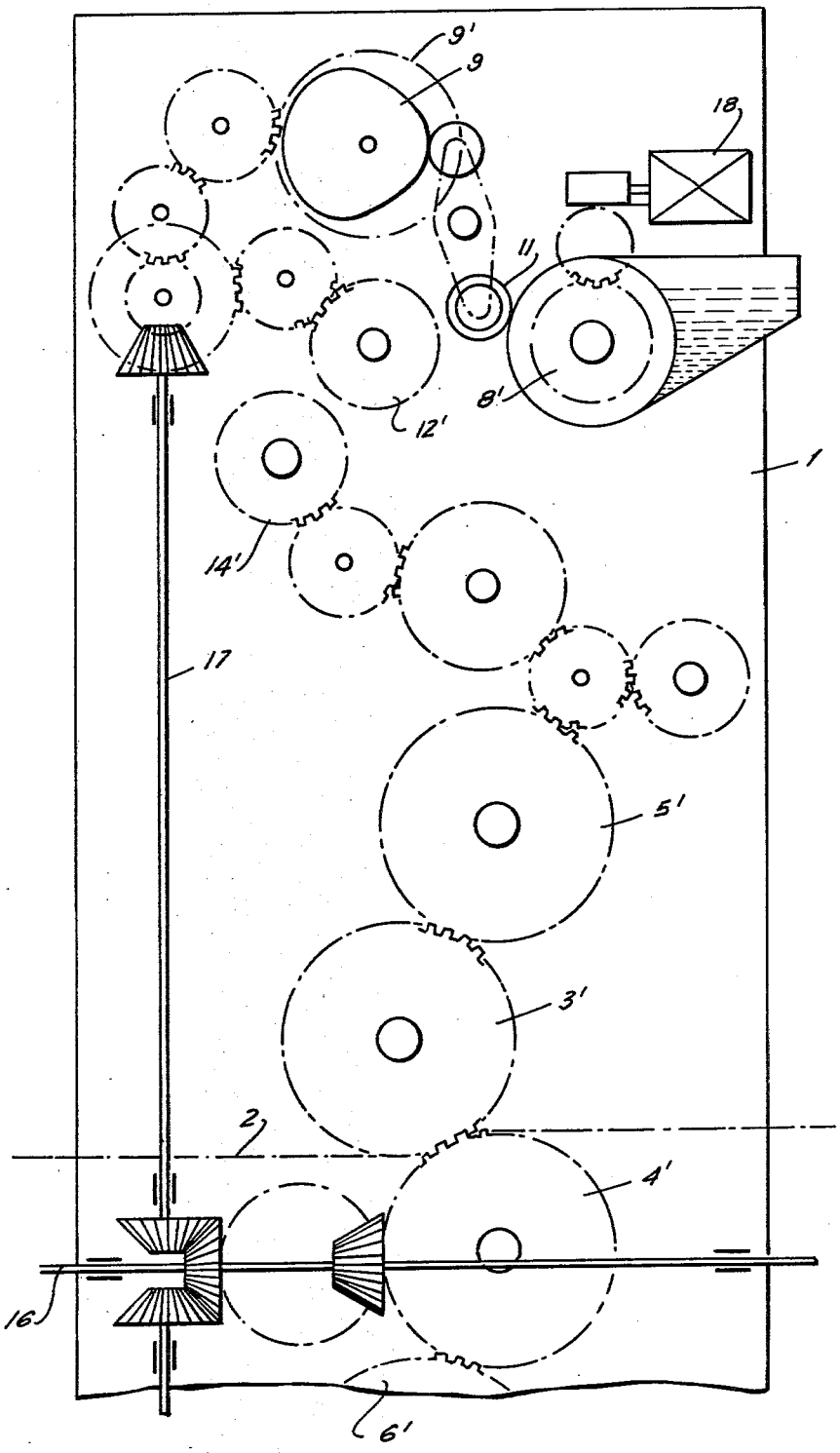
FIG. 2 is a diagrammatic representation of a driving train for driving the arrangement of FIG. 1.
Figure 3:
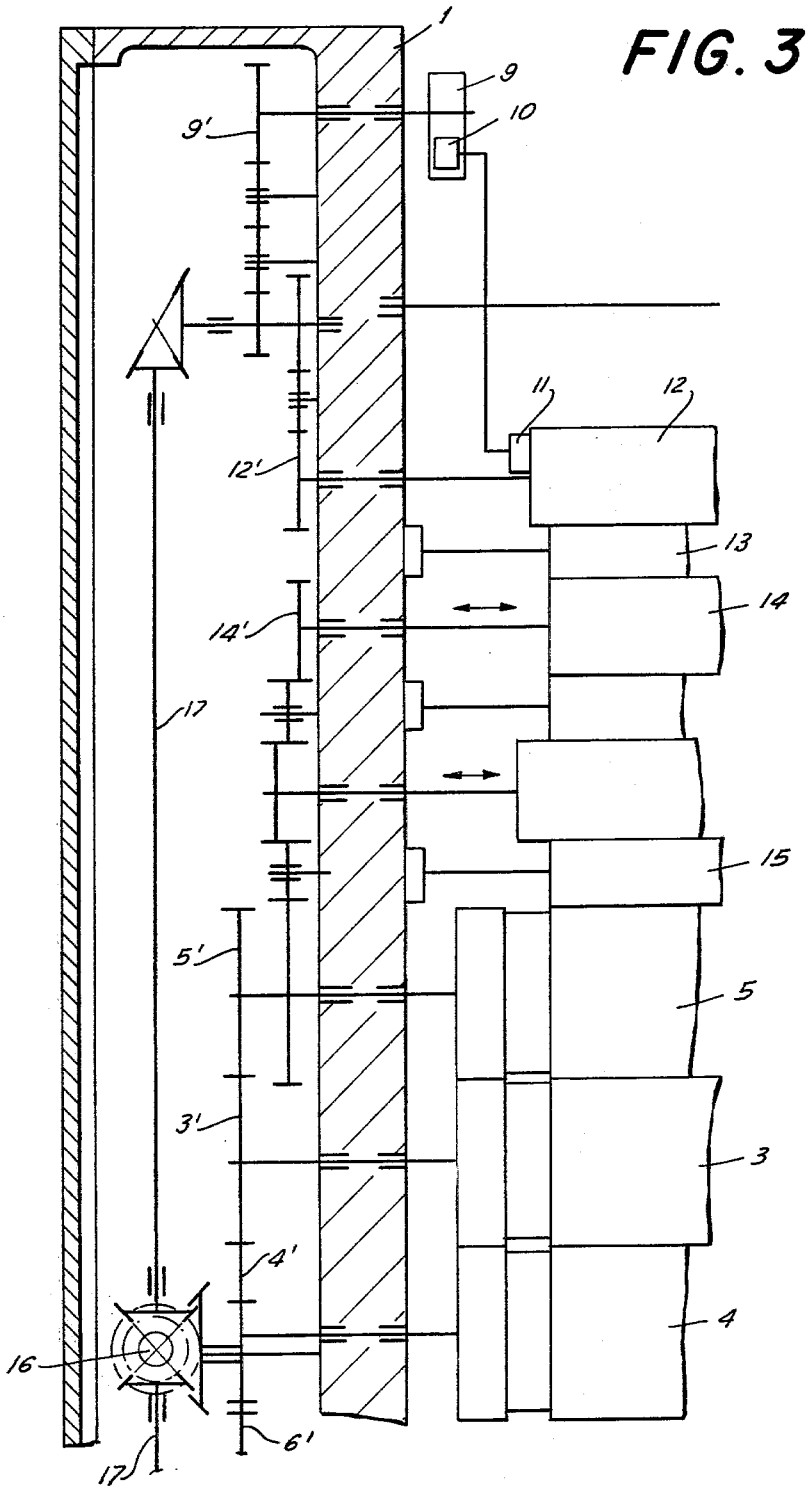
FIG. 3 is a somewhat diagrammatic partly sectioned view especially illustrating the drive of FIG. 2.

As a comparison of FIGS. 1 and 3 with FIG. 2 will reveal, two separate gear transmission branches are provided. First of all, it is to be mentioned that the drive includes a main driving shaft 16 which is driven in rotation in any known and conventional manner, usually by a motor of a conventional construction. The main driving shaft 16 drives gears 4' and 3' which, in turn, drive the gears 5' and 6'. This particular branch of the transmission also drives all of the gears of the distributing rollers up to the gear 14' of the distributing roller 14. On the other hand, a gear 12' which is associated with the first distributing roller 12 is driven in rotation by a different branch of the transmission which includes intermediate gears which achieve the necessary transmission ratio, this additional branch also including an additional driving shaft 17 which is in a direct meshing engagement with the main driving shaft 16.

In view of the above explanation, it will become apparent that, while the gear wheels 12', 14' and thus the distributing rollers 12, 14 derive their rotation from the same shaft 16, two separate transmission branches, including a multitude of intermeshing gears are interposed between the main shaft 16 and the respective gear wheels 12' and 14' so that any disturbance at the distributing roller 12 will not influence the operation of those components of the printing press which are driven by the other branch of the transmission which terminates at the distributing roller 14. In addition thereto, the solely frictional contact of the transfer roller 13 with each of the distributing rollers 12 and 14 will further contribute to the elimination of transfer of any oscillations between the rollers 12 and 14.

It will be understood that each of the elements described above, or two or more together, may also find a useful application in other types of constructions differing from the types described above.

While the invention has been illustrated and described as embodied in a drive for an ink-supplying device of a rotary offset printing press, it is not intended to be limited to the details shown, since various modifications and structural changes may be made without departing in any way from the spirit of the present invention. So, for instance, instead of the illustrated transmission via bevel gears, the same transmission effect could also be achieved by resorting to chain transmissions or toothed-belt transmissions. Also, while it has been illustrated that a separate motor 18 drives the ink-supply roll 18 in rotation, the corresponding gear 18' thereof could be incorporated, by using corresponding intermediate gears, into the gear train leading, for instance, to the gear wheel 9' associated with the cam 9.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a rotary printing press, a combination comprising a support; means for printing images on an advancing web, including at least one plate cylinder mounted on said support for rotation and at least one blanket cylinder rotatably mounted on said support intermediate and in contact with said plate cylinder and with the advancing web; means for supplying printing ink to said plate cylinder, including an ink supply fountain, an ink supply roll thereat, a succession of alternately arranged distributing and transfer rollers mounted on said support for rotation in contact with one another; application rollers arranged between at least one distributing roller at one end of said succession and said plate cylinder, and means for periodically delivering the ink from said ink supply roll to another distributing roller at the other end of said succession, including a ductor roll mounted on said support for rotation and for displacement between a replenishing and a delivering position in contact with said ink supply roll and with said another distributing roller, respectively; and means for driving said printing and supplying means, including a main driving shaft and a first gear transmission that drives directly from said main driving shaft said distributing rollers except said another distributing roller and an additional driving shaft and a second gear transmission that drives said another distributing roller so that the remaining rollers are unaffected when said another distributing roller is subjected to a jolt upon contact with said ductor roll in said delivering position.

2. A combination as defined in claim 1, wherein one transfer roller which is interposed between said another distributing roller and one of said remaining distributing rollers in said succession is driven in rotation by friction with said distributing rollers.

3. A combination as defined in claim 1, wherein said first transmission also drives said plate and blanket cylinders.

4. A combination as defined in claim 1, wherein said transfer rollers are coated with a layer of rubber.

5. A combination as defined in claim 1, wherein said application rollers are coated with a layer of rubber.

6. A combination as defined in claim 1; wherein said supplying means further includes means for mounting said ductor roll on said support for displacement between said replenishing and delivering positions, and means for displacing said ductor roll between said positions thereof; and wherein said second transmission also drives said displacing means.

7. A combination as defined in claim 6, wherein said displacing means includes a cam mounted on said support for rotation, and a cam follower connected to said ductor roll for joint displacement therewith.

8. A combination as defined in claim 1, wherein said second transmission also drives said ink supply roll.

9. A combination as defined in claim 1, wherein said second transmission drives said ink supply roll and said another distributing roller at different peripheral speeds.

* * * * *